US006707242B2

(12) United States Patent
Ito et al.

(10) Patent No.: US 6,707,242 B2
(45) Date of Patent: Mar. 16, 2004

(54) COLOR CATHODE RAY TUBE

(75) Inventors: Yoichi Ito, Kawasaki (JP); Koji Hagiwara, Choseimura (JP)

(73) Assignees: Hitachi, Ltd., Tokyo (JP); Hitachi Electronic Devices, Chiba-ken (JP)

( * ) Notice: Subject to any disclaimer, the term of this patent is extended or adjusted under 35 U.S.C. 154(b) by 0 days.

(21) Appl. No.: 10/167,197

(22) Filed: Jun. 11, 2002

(65) Prior Publication Data

US 2003/0001481 A1 Jan. 2, 2003

(30) Foreign Application Priority Data

Jul. 2, 2001 (JP) ..... 2001-201045

(51) Int. Cl.[7] ..... H01J 29/80

(52) U.S. Cl. ..... 313/402; 313/404; 313/407; 313/408

(58) Field of Search ..... 313/402, 404, 313/407, 408

(56) References Cited

U.S. PATENT DOCUMENTS 5,210,459 A * 5/1993 Lee
5,506,466 A * 4/1996 Shoda et al.
5,644,192 A * 7/1997 Ragland, Jr.

* cited by examiner

*Primary Examiner*—Sandra O'Shea
*Assistant Examiner*—Sumati Krishnan
(74) *Attorney, Agent, or Firm*—Milbank, Tweed, Hadley & McCloy LLP

(57) ABSTRACT

The invention provides a color cathode ray tube using a shadow mask capable of avoiding ruptures or cracks during press-working. The shadow mask has an apertured region having color selecting apertures, and an unapertured region which surrounds the apertured region. A skirt portion is bent from the unapertured region in the direction of the tube axis. The shadow mask has at least two inclined surfaces in a boundary portion between the unapertured region and the skirt portion.

9 Claims, 5 Drawing Sheets

COLOR CATHODE RAY TUBE

BACKGROUND OF THE INVENTION

The present invention relates to a shadow mask type of color cathode ray tube, and more particularly, to a highly reliable color cathode ray tube in which a shadow mask which serves as a color selecting electrode is improved in formability and shock resistance and is reduced in thermal deformation.

Color cathode ray tubes of the flat face type in which panels (face panels) which constitute image display screens are flattened have rapidly become popular as recent color cathode ray tubes for use as display units in monitor devices for information equipment and color television sets. In the case of a press-molded type of shadow mask (pressed mask) in which an apertured surface is curved in the horizontal and vertical directions, the panel of this flat face type of color cathode ray tube (flat face tube) has an outer surface which is approximately planar, and an inner surface which has a curvature fairly larger than that of the outer surface.

One technical problem encountered in the design of such a flat face tube is the strength of the shadow mask. The shadow mask is molded to have a curvature approximate to that of the inner surface of the panel. Since the inner surface of the panel of the flat face tube has a small curvature compared to a round face tube having curved inner and outer surfaces, the curvature of the shadow mask of the flat face tube must be made small.

For this reason, during press-molding of a plate-shaped member in which color selecting apertures (hereinafter referred to also as electron beam apertures) are formed, a rupture occasionally occurs in a boundary portion between an unapertured region surrounding an apertured region in which the electron beam apertures are formed, and a skirt portion bent from the unapertured region in the direction of the tube axis of the flat face tube, and the rupture leads to defective products. In addition, bridge portions are occasionally cut in the vicinity of the unapertured region.

In addition, a molded shadow mask is occasionally deformed during the process of fixedly securing the shadow mask to a frame, during the process of securing a shadow mask assembly to a panel, or during the transfer of a color cathode ray tube. Furthermore, it is difficult to ensure the strength of the shadow mask against a so-called doming phenomenon such as partial thermal deformation of the apertured region or thermal deformation of the entire shadow mask which occur when the temperature of the shadow mask rises due to collision of electron beams with the shadow mask.

A shadow mask is known in which a step, an inclined surface or a bent portion is formed in a boundary portion between the periphery of the apertured region of its main surface and its skirt portion. This kind of related art is disclosed in, for example, Japanese Utility Model Laid-Open Nos. 40941/1985 and 95334/1992 and Japanese Patent Laid-Open Nos. 349415/1994 and 96726/1996.

As described above, with the recent development of flatter shadow masks (flatter faces), pressures to be applied to shadow masks during press-molding have become larger. Accordingly, it is impossible to directly apply the countermeasures of the above-enumerated related arts to shadow masks for flat faces.

The invention provides a highly reliable color cathode ray tube in which its shadow mask is improved in formability and shock resistance and is reduced in thermal deformation by solving the various problems of the related-art shadow masks.

SUMMARY OF THE INVENTION

The gist of the invention for achieving the above object is that a shadow mask incorporated in a color cathode ray tube has a transitional portion made of at least two inclined surfaces in a boundary portion between the outside of an unapertured portion and a skirt portion of the shadow mask.

(1) A color cathode ray tube includes: an evacuated envelope including a panel having an inner surface coated with a fluorescent material for a plurality of colors, a neck in which is housed an electron gun which emits electron beams in a direction of a tube axis of the color cathode ray tube, and a funnel connecting the panel and the neck; and a shadow mask assembly having an apertured region having a multiplicity of color selecting apertures in a main surface disposed in close proximity to and in opposition to the fluorescent material coated on the inner surface of the panel, an unapertured region which surrounds the apertured region, and a skirt portion which is bent in the direction of the tube axis from the unapertured region. In the color cathode ray tube, a transitional portion made of at least two inclined surfaces is provided in a boundary portion between the unapertured region and the skirt portion except the corners of the periphery of the unapertured portion.

(2) In (1), the transitional portion has an outside inclined surface on a side closer to the skirt portion and an inside inclined surface on a side closer to the apertured region, and an angle of the outside inclined surface with respect to the tube axis and an angle of the inside inclined surface in the skirt portion side against the tube axis are both greater than 90°.

(3) In (1) or (2), an angle formed by the outside inclined surface and the inside inclined surface is in a range of $90° < \theta 1 \leqq 135°$.

(4) In any of (1) to (3), each of the outer and inside inclined surfaces has an area gradually decreased toward corners of the panel.

(5) In any of (1) to (4), the inside inclined surface has opposite ends located at positions set back from the outside inclined surface at the respective corners.

(6) In any of (1) to (4), the outside inclined surface has opposite ends located at positions set back from the inside inclined surface at the respective corners.

(7) In any of (1) to (6), a curvature of the inside inclined surface, as viewed from the tube axis, is greater than a curvature of the outside inclined surface.

According to each of the above-described constructions, it is possible to prevent a rupture in a shadow mask due to press-working and provide a color cathode ray tube of high reliability which uses a pressed mask resistant to external shock and reduced in thermal deformation.

The number of the inclined surfaces which constitute the transitional portion is not limited to two, and may also be three or four or more as long as press-molding is allowed. In this case, it is desirable that a plurality of inside inclined surfaces be connected to one outside inclined surface. Incidentally, the invention is not limited to any of the above-described constructions nor to any of structures which will be described later in connection with embodiments, and it goes without saying that various modifications can be made without departing from the technical idea of the invention.

BRIEF DESCRIPTION OF THE DRAWINGS

The invention will be more readily appreciated and understood from the following detailed description of preferred embodiments of the invention when taken in conjunction with the accompanying drawings, in which.

DESCRIPTION OF THE PREFERRED EMBODIMENTS

Preferred embodiments of the invention will be described below in detail with reference to the drawings of the embodiments.

Figure 1:
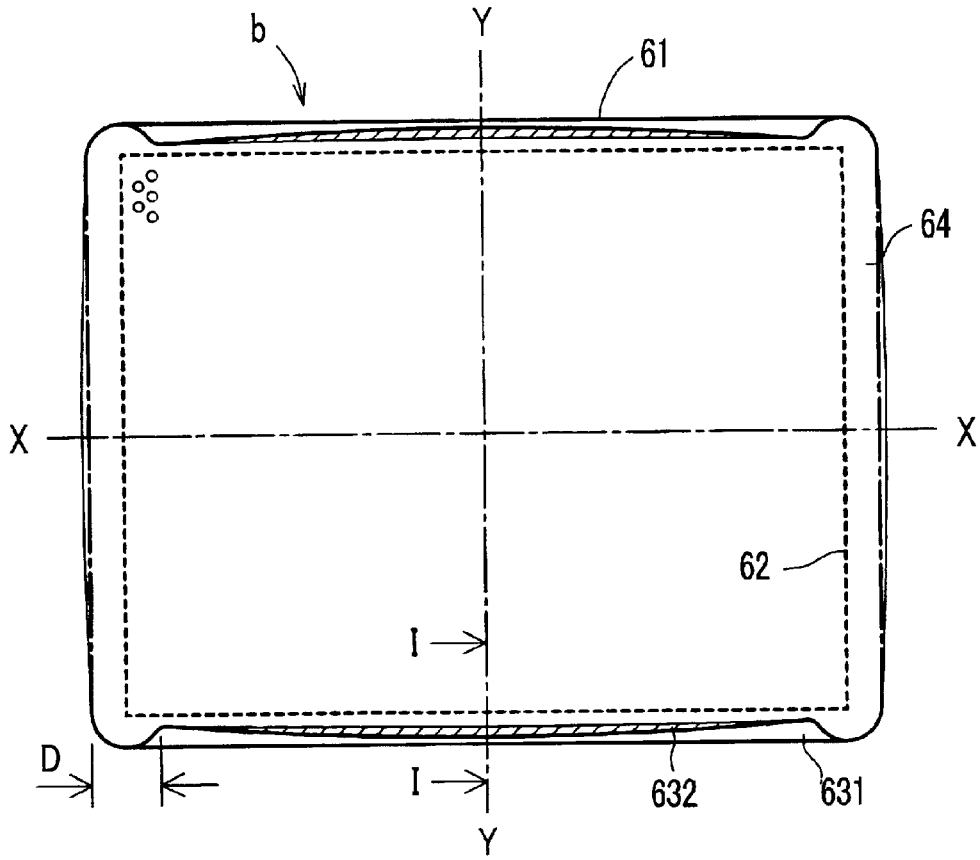
FIG. 1 is a plan view of a shadow mask, illustrating a first embodiment of the color cathode ray tube according to the invention.
Figure 2:
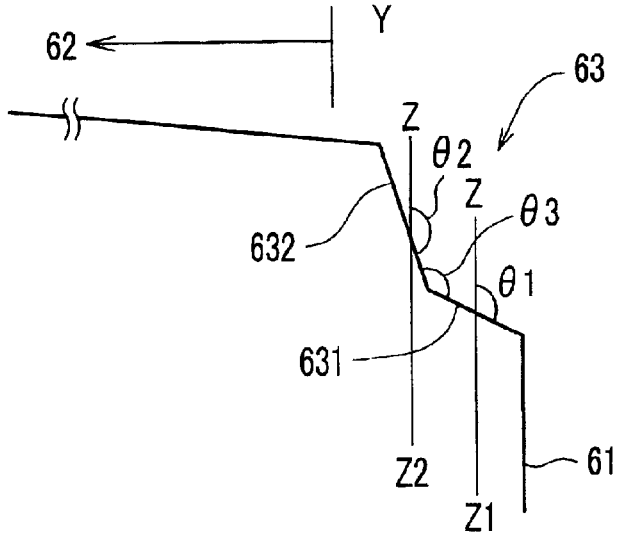
FIG. 2 is a partial cross-sectional view taken along line I—I of FIG. 1.

FIG. 1 is a plan view of a shadow mask 6, illustrating a first embodiment of the color cathode ray tube according to the invention, and FIG. 2 is a partial cross-sectional view taken along line I—I of FIG. 1. The plane shape of a shadow mask 6 is approximately rectangular as viewed from the front side of its panel. In FIG. 1, an axis X corresponds to a long axis indicative of the horizontal scanning direction of the color cathode ray tube, while an axis Y corresponds to a short axis indicative of the vertical scanning direction of the color cathode ray tube. The shadow mask has long sides approximately parallel to the long axis X and short sides approximately parallel to the short axis Y. This shadow mask 6 has an apertured region 62 in which electron beam apertures which serve as a multiplicity of color selecting apertures are formed, an unapertured region 64 which surrounds the apertured region 62, and a skirt portion 61 which is bent in the tube-axis direction of the color cathode ray tube from the unapertured region 64.

In the first embodiment, transitional portions 63 each made of two inclined surfaces are formed on the respective long sides except their corners at the boundary portion between the unapertured region 64 and the skirt portion 61. Each of the transitional portions 63 is formed so that the areas of its inclined surfaces are gradually decreased from the center toward the opposite ends of a corresponding one of the long sides. The opposite ends of each of the transitional portions 63 are terminated at positions set back from the respective corners by a distance D. Although this distance D depends on the screen size, the plate thickness and the extent of curvature of the apertured region of a color cathode ray tube into which the shadow mask is to be incorporated, the distance D is approximately 10 mm, for example, in the case of a shadow mask used in a color cathode ray tube of about 51 cm in diagonal length.

As shown in FIG. 2, each of the transitional portions 63 of the first embodiment has two inclined surfaces, an outside inclined surface 631 formed on a side closer to the skirt portion 61 and an inside inclined surfaces 632 formed on a side closer to the apertured region 62.

An angle θ1 is an angle formed by an axis Z1 parallel to a tube axis Z and a skirt-side portion of the outside inclined surface 631. An angle θ2 is an angle formed by an axis Z2 parallel to the tube axis Z and a skirt-side surface of the inside inclined surface 632. An angle θ3 is an angle formed by the outside inclined surface 631 and the inside inclined surface 632.

In FIG. 2, the angle θ1 is 105°, the angle θ2 is 150°, and the angle θ3 is 135°.

The angle θ1 of the outside inclined surface 631 is an angle of inclination of not smaller than 90°, and is formed in the range of $90° \leqq \theta 1 \leqq 135°$.

The angle θ2 of the inside inclined surface 632 is greater than 90°, and is formed in the range of $135° \leqq \theta 2 \leqq 180°$. Since the angle θ2 is formed in the range of $135° \leqq \theta 2 \leqq 180°$, the deformation of the electron beam apertures can be restrained.

In addition, the angle θ1 is smaller than the angle θ2 ($\theta 1 \leqq \theta 2$).

The angle θ3 formed by the outside inclined surface 631 and the inside inclined surface 632 is greater than 90°, a preferably $90 \leqq \theta 3 \leqq 135°$.

Figure 3:
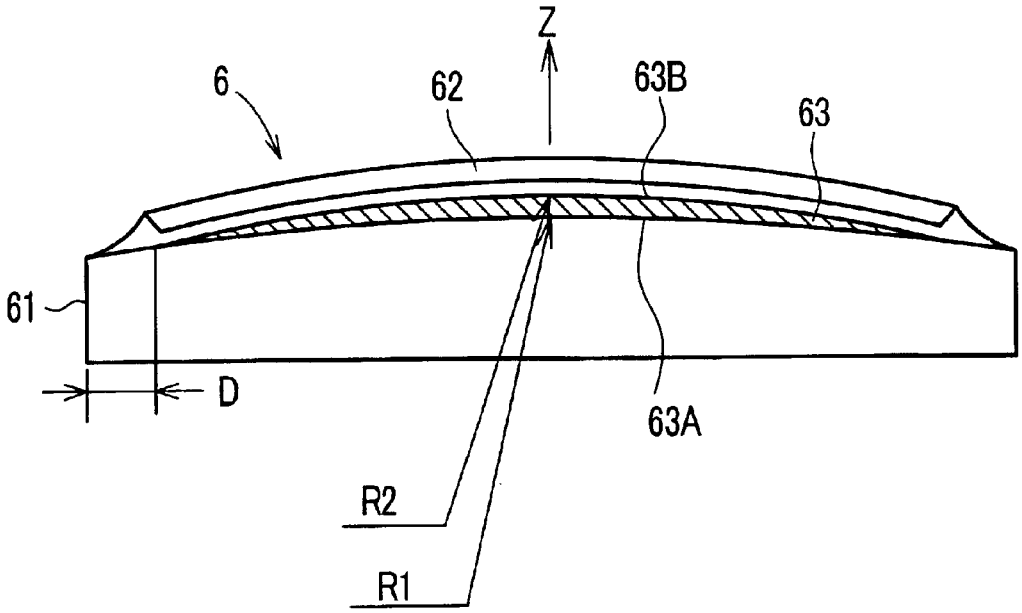
FIG. 3 is a schematic view illustrating the shape of a shadow mask in greater detail and aiding in describing a first embodiment of the color cathode ray tube according to the invention.

FIG. 3 is a schematic view illustrating the shape of the shadow mask in greater detail and aiding in describing the first embodiment of the color cathode ray tube according to the invention. In FIG. 3, the same reference numerals as those used in FIGS. 1 and 2 denote portions which are the same as the corresponding portions shown in FIGS. 1 and 2. In FIG. 3, the transitional portion 63 is represented by a skirt-side edge 63A of the outside inclined surface 631 and an apertured-region-side edge 63B of the inside inclined surface 632.

A curvature R1 of the skirt-side edge 63A of the outside inclined surface 631 is smaller than a curvature R2 of the apertured-region-side edge 63B of the inside inclined surface 632. Accordingly, the area of the transitional portion 63 is gradually decreased from its center parallel to the tube axis Z toward each of its opposite ends.

The shadow mask having the above-described construction is highly resistant to external forces owing to the formation of the transitional portion 63. In addition, since the transitional portion 63 constitutes a buffer portion against thermal deformation, the deformation of the shadow mask during a working process is prevented, and thermal deformation during operation is restrained from occurring in a color cathode ray tube which is finished with such shadow mask incorporated therein. Furthermore, when a plate-shaped member is press-worked, no excessive shearing forces are applied to the transitional portion 63, whereby ruptures and cracks such as the above-described ones can be prevented.

Figure 4:
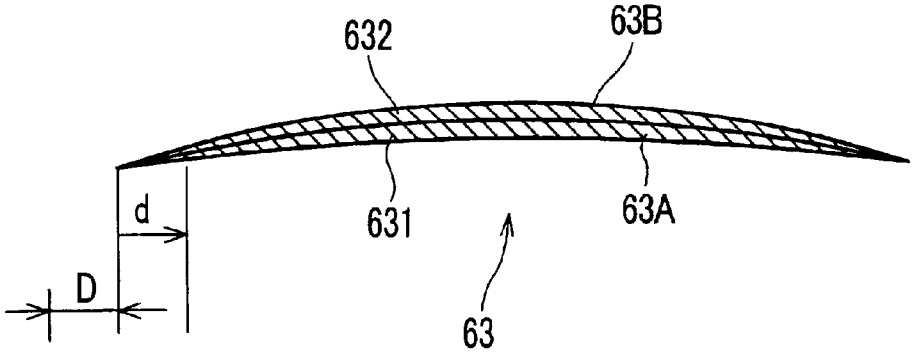
FIG. 4 is a schematic view illustrating another shape of the shadow mask in greater detail and aiding in describing a second embodiment of the color cathode ray tube according to the invention.

FIG. 4 is a schematic view illustrating another shape of the shadow mask in greater detail and aiding in describing a second embodiment of the color cathode ray tube according to the invention. In FIG. 4, the same reference numerals as those used in FIG. 3 denote portions which are the same as the corresponding portions shown in FIG. 3. In the second embodiment, the opposite ends of the inside inclined surface 632 of each of the transitional portions 63 are terminated at positions set back by a distance D from the respective opposite ends of the outside inclined surface 631. This distance D is set to an optimum value according to the size, the plate thickness and the like of the shadow mask. According to the second embodiment as well, the deformation of the shadow mask during a working process is prevented, and thermal deformation during operation is restrained from occurring in a color cathode ray tube which is finished with such shadow mask incorporated therein. Furthermore, when a plate-shaped member is press-worked, no excessive shearing forces are applied to the transitional portion 63, whereby ruptures and cracks such as the above-described ones can be prevented.

Figure 5:
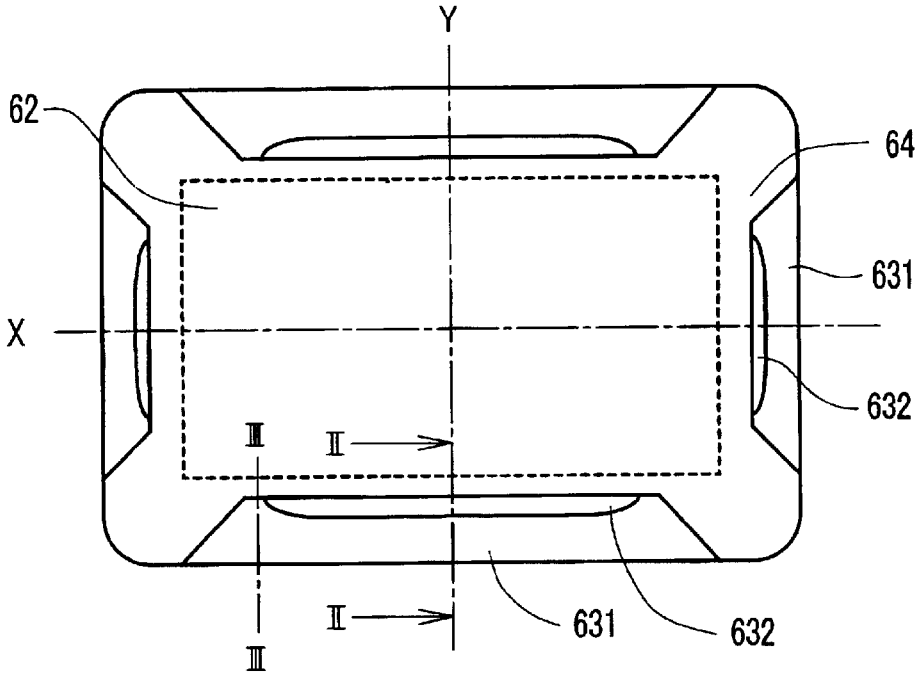
FIG. 5 is a plan view of the shadow mask, aiding in describing a third embodiment.

In a third embodiment of the invention, transitional portions similar to the above-described transitional portions 63 are also formed on the short sides of a shadow mask. FIG. 5 is a plan view of the shadow mask, aiding in describing the third embodiment. A plurality of inclined portions are provided on the long and short sides of the shadow mask. The construction of each of the transitional portions in the third embodiment is similar to that described above in connection with each of the first and second embodiments. Particularly when the transitional portions are formed on all of the long and short sides of a shadow mask for a large-sized color cathode ray tube of not smaller than 51 cm in diagonal length, advantages similar to those of each of the first and second embodiments can be achieved in the entire area of the shadow mask including the X- and Y-axis directions.

Figure 6:
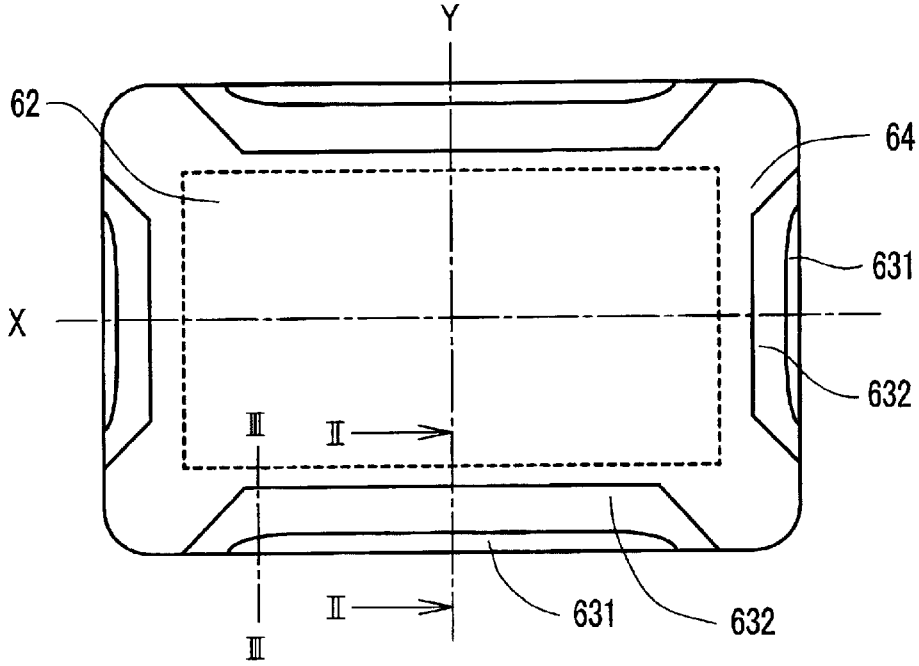
FIG. 6 is a plan view of a shadow mask, aiding in a fourth embodiment of the invention.
Figure 7:
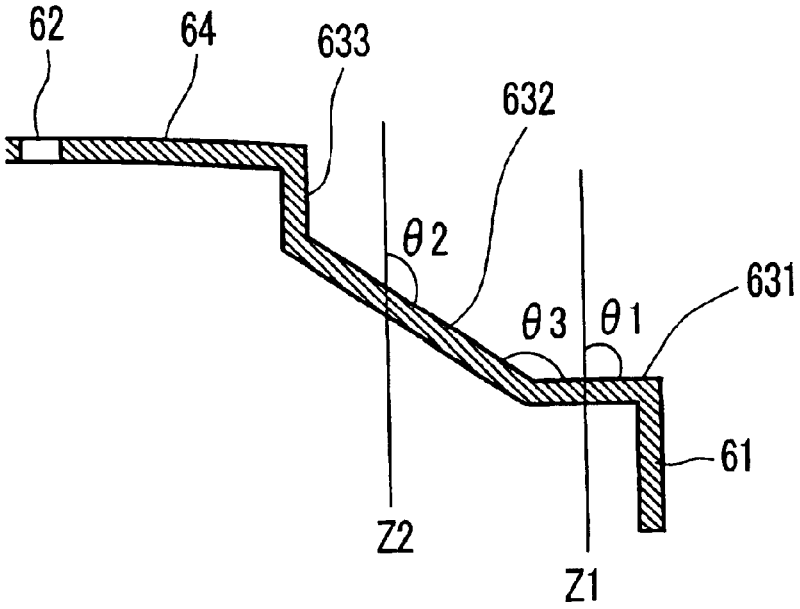
FIG. 7 is a cross-sectional view taken along line II—II of FIG. 6.
Figure 8:
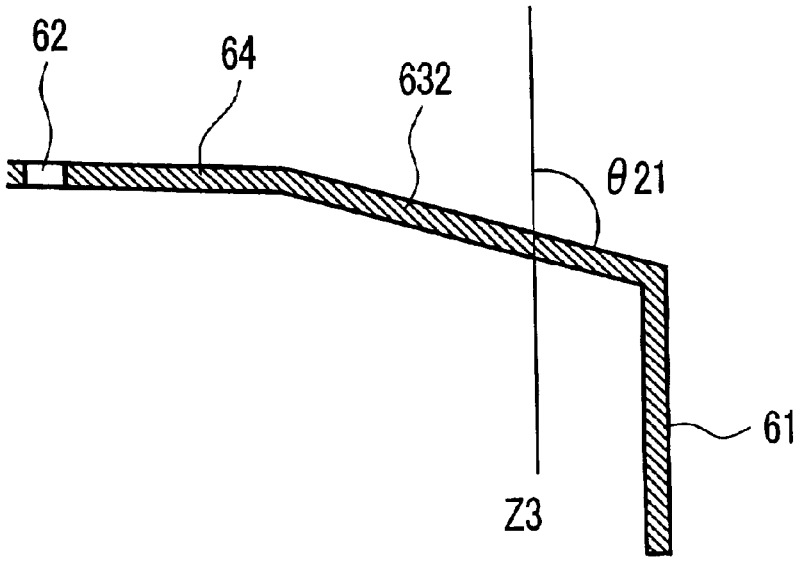
FIG. 8 is a cross-sectional view taken along line III—III of FIG. 6.

FIG. 6 is a plan view of a shadow mask, aiding in a fourth embodiment of the invention. FIG. 7 is a cross-sectional view taken along line II—II of FIG. 6, and FIG. 8 is a cross-sectional view taken along line III—III of FIG. 6. The same portions as those shown in FIG. 3 are denoted by the same reference numerals as those used in FIG. 2.

The angle θ1 is an angle formed by the axis Z1 parallel to the tube axis Z and a skirt-side portion of the outside inclined surface 631. The angle θ2 is an angle formed by the axis Z2 parallel to the tube axis Z and a skirt-side surface of the inside inclined surface 632. In the fourth embodiment, the angle θ1 of the outside inclined surface 631 is 90°. The angle θ2 of the inside inclined surface 632 is greater than 90°. The angle θ3 formed by the outside inclined surface 631 and the inside inclined surface 632 is not smaller than 90°, preferably $90 \leqq \theta 3 \leqq 135°$.

The third embodiment also has a side surface 633 approximately parallel to the tube axis Z on an apertured-surface side of the inside inclined surface 632. The apertured portion of the shadow mask is easily warped toward an electron gun at the periphery of the short axis Y. By forming the side surface 633 in the center of each of the sides, it is possible to restrain the warp of the apertured portion of the shadow mask far more effectively.

The area of each of the inside inclined surfaces 632 along the respective sides is gradually increased toward each of the corners of the corresponding one of the sides. On the other hand, each of the outside inclined surfaces 631 and the side surfaces 633 along the respective sides is gradually decreased toward each of the corners of the corresponding one of the sides.

In the central portion of each of the sides of the shadow mask, a transitional portion between the unapertured region 64 and the skirt portion 61 is formed in a staircase-like shape including the inside inclined surface 632. The transitional portion between the unapertured region 64 and the skirt portion 61 is formed to gradually become an inclined surface toward each of the corners. An angle θ21 is an angle formed by the inclined surface near each of the corners and an axis Z3 parallel to the tube axis.

The angle θ21 of the inside inclined surface 632 in the vicinity of each of the corners of each side of the shadow mask is smaller than the angle θ2 in the center of each side of the shadow mask (θ2>θ21). The angle θ21 of the inside inclined surface 632 in the vicinity of each of the corners is greater than 90° (θ21>θ90). In the vicinity of each of the corners, the angle formed by the unapertured region 64 and the inside inclined surface 632 is greater than 90°, whereby the deformation of electron beam apertures in each of the corners can be restrained during press-molding of the shadow mask.

According to the above-described construction, it is possible to restrain the shadow mask from being deformed when a cathode ray tube falls by accident. Furthermore, the deformation of electron beam apertures positioned in each of the corners can be restrained during press-molding of the shadow mask.

In another construction, the angle θ1 may be made gradually closer to the angle θ21 from the center toward the vicinity of each of the corners of each side. In another construction, the angle θ3 may be made gradually closer to 180° from the center toward the vicinity of each of the corners of each side. In yet another construction, the side surface 633 may be gradually inclined from the center toward the vicinity of each of the corners of each side.

Figure 9:
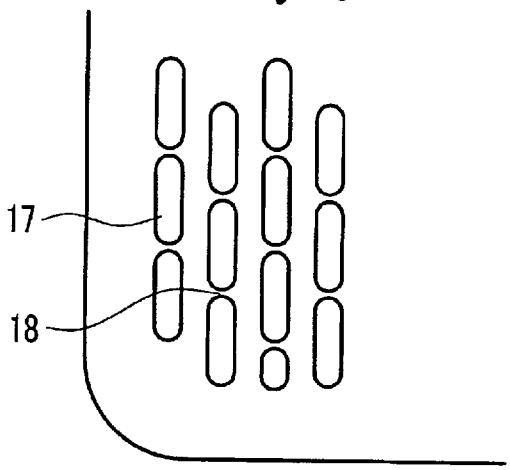
FIG. 9 is a partial enlarged view of electron beam apertures in a stripe type of shadow mask.

FIG. 9 is a partial enlarged view of electron beam apertures in a stripe type of shadow mask. Each bridge portion 18 exists between vertically adjacent ones of electron beam apertures 17.

Since the bridge portions 18 of the stripe type of shadow mask are thin, the bridge portions 18 are easily cut during press-molding. Since the corners of the shadow mask are worked by drawing, bridges portions positioned in the vicinity of the corners are particularly easily cut.

According to the fourth embodiment, the cutting of the bridge portions can be restrained. In the vicinity of the respective corners in particular, since the inclined surfaces are formed, the angle formed by the unapertured portion and each of the inclined surfaces becomes large and the angle formed by each of the inclined surfaces and the skirt portion becomes large, whereby loads on the bridge portions are reduced. Accordingly, it is possible to restrain the cutting of the bridge portions in the vicinity of the corners.

Figure 10:
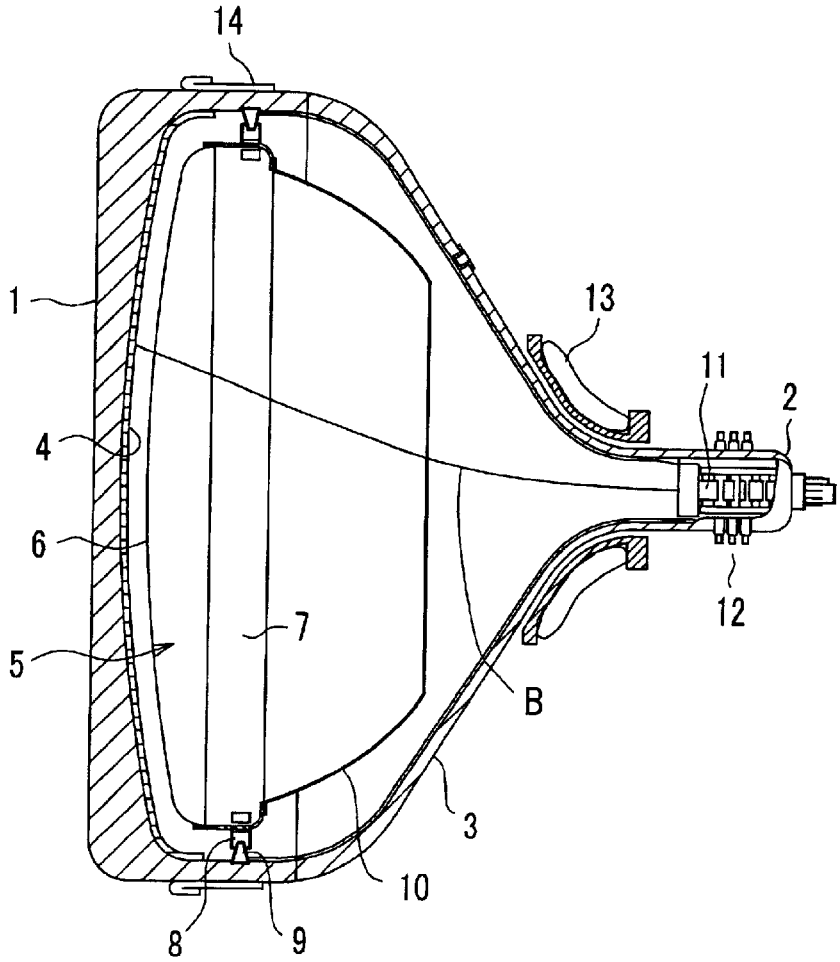
FIG. 10 is a cross-sectional view schematically illustrating the entire construction of a color cathode ray tube according to the invention.

FIG. 10 is a cross-sectional view schematically illustrating the entire construction of a color cathode ray tube according to the invention. This color cathode ray tube has an evacuated envelope which is made of a panel (face panel) 1 having an inner surface coated with a fluorescent material 4 for a plurality of colors, a neck 2 in which an electron gun 11 is housed, and a funnel 3 which connects the panel 1 and the neck 2.

The inner surface of the panel 1 is coated with the fluorescent material 4 for three colors, and a shadow mask 6 having a multiplicity of color selecting apertures is disposed in close proximity to the fluorescent material 4. Reference numeral 5 denotes a shadow mask assembly. The shadow mask 6 which constitutes this shadow mask assembly has the construction described above in connection with any of the embodiments, and has a multiplicity of electron beam apertures processed by etching. The shadow mask 6 is secured with its skirt portion welded to a mask frame 7.

A magnetic shield 10 for shielding electron beams from external magnetic fields is secured to the electron-gun side of the shadow mask assembly 5. The shadow mask assembly 5 is secured to stud pins 9 protrusively disposed on an inner side wall of the panel 1, by a suspension spring mechanism 8 fixed to the frame 7. A magnetic unit 12 for color purity correction and centering correction is secured to the external portion of the neck 2, and a deflection yoke 13 is fitted on a portion between the neck 2 and the funnel 3. Incidentally, reference numeral 14 denotes a reinforcing band. Three electron beams B emitted from the electron gun 11 are deflected in both horizontal and vertical directions by the magnetic field of the deflection yoke 13, and two-dimensionally scan a fluorescent screen to reproduce an image.

As is apparent from the foregoing description, according to representative constructions of the invention, since a transitional portion made of two inclined surfaces is formed on a shadow mask which is a color selecting electrode, the deformation of the shadow mask can be restrained. Since excessive shearing forces are not applied to the transitional portion when a plate-shaped member is press-worked, the above-described ruptures and cracks can be prevented. In addition, the strength of a shadow mask made of a thin plate is greatly improved to reduce the occurrence of partial thermal deformation and doming, whereby it is possible to provide a color cathode ray tube including a thin face panel having high luminance and high resolution.

What is claimed is:

1. A color cathode ray tube comprising:

an evacuated envelope including a panel having an inner surface coated with a fluorescent layer for a plurality of colors, a neck in which is housed an electron gun which emits electron beams in a direction of a tube axis of the color cathode ray tube, and a funnel connecting the panel and the neck; and a shadow mask assembly disposed in the inside of the panel, the shadow mask assembly including a shadow mask and a frame being;

the shadow mask having, in its main surface opposed to the fluorescent layer, an approximately rectangular apertured region having a multiplicity of color selecting apertures, an unapertured region which surrounds the apertured region, and a skirt portion which is bent in the direction of the tube axis from a periphery of the unapertured region, a transitional portion made of at least two inclined surfaces being provided in a boundary portion between the unapertured region and the skirt portion, and the transitional portion has an outside inclined surface on a side closer to the skirt portion and an inside inclined surface on a side closer to the apertured region, and an angle of the outside inclined surface with respect to the tube axis and an angle of the inside inclined surface in the skirt portion side against the tube axis are both greater than 90°.

2. A color cathode ray tube according to claim 1, wherein an angle $\theta 1$ formed by the outside inclined surface and the inside inclined surface is in a range of $90° < \theta 1 \leqq 135°$.

3. A color cathode ray tube according to claim 1, wherein the shadow mask shaped approximately rectangular which have two long sides, two short sides and four corner portions, each of the outer and inside inclined surfaces established at the side has an area gradually decreased toward the corner portion.

4. A color cathode ray tube according to claim 3, wherein the inside inclined surface has opposite ends located at positions set bask from the outside inclined surface at the respective corners.

5. A color cathode ray tube according to claim 3, wherein the outside inclined surface has opposite ends located at positions set back from the inside inclined surface at the respective corners.

6. A color cathode ray tube according to claim 3, wherein a curvature of the inside inclined surface, as viewed from the tube axis, is greater than a curvature of the outside inclined surface.

7. A color cathode ray tube according to claim 1, wherein the inside inclined surface has opposite ends located at positions set bask from the outside inclined surface at the respective corners.

8. A color cathode ray tube according to claim 1, wherein the outside inclined surface has opposite ends located at positions set back from the inside inclined surface at the respective corners.

9. A color cathode ray tube according to claim 1, wherein a curvature of the inside inclined surface, as viewed from the tube axis, is greater than a curvature of the outside inclined surface.

* * * * *